US005549867A

United States Patent [19]

Gessner et al.

[11] Patent Number: 5,549,867

[45] Date of Patent: Aug. 27, 1996

[54] DISTRIBUTION ENHANCED POLYOLEFIN MELTSPINNING PROCESS AND PRODUCT

[75] Inventors: Scott L. Gessner, Encinitas, Calif.; William Fowells, Washougal, Wash.

[73] Assignee: Fiberweb North America, Inc., Simpsonville, S.C.

[21] Appl. No.: 333,651

[22] Filed: Nov. 3, 1994

[51] Int. Cl.[6] ..... D01D 5/088; D01F 6/04

[52] U.S. Cl. ..... 264/555; 264/211.12; 264/211.14; 264/571

[58] Field of Search ..... 264/211.12, 211.14, 264/555, 571

[56] References Cited

U.S. PATENT DOCUMENTS

| | | | |
|---|---|---|---|
| 3,183,283 | 5/1965 | Reding | 525/240 |
| 3,472,829 | 10/1969 | Claybaugh et al. | 526/79 |
| 3,522,198 | 7/1970 | Tamada et al. | 524/490 |
| 4,230,831 | 10/1980 | Sakurai et al. | 525/240 |
| 4,296,022 | 10/1981 | Hudson | 524/349 |
| 4,336,352 | 6/1982 | Sakurai et al. | 525/240 |
| 4,461,873 | 7/1984 | Bailey et al. | 525/240 |
| 4,487,875 | 12/1984 | Nakajima et al. | 524/385 |
| 4,500,682 | 2/1985 | Chiba et al. | 525/240 |
| 4,530,914 | 7/1985 | Ewen et al. | 502/113 |
| 4,536,550 | 8/1985 | Moriguchi et al. | 525/240 |
| 4,547,551 | 10/1985 | Bailey et al. | 525/240 |
| 4,626,467 | 12/1986 | Hostetter | 428/288 |
| 4,644,045 | 2/1987 | Fowells | 526/348 |
| 4,786,697 | 11/1988 | Cozewith et al. | 526/88 |
| 4,789,714 | 12/1988 | Cozewith et al. | 526/88 |
| 4,792,588 | 12/1988 | Suga et al. | 525/240 |
| 4,842,922 | 6/1989 | Krupp et al. | 428/198 |
| 4,863,790 | 9/1989 | Horacek et al. | 428/285 |
| 4,874,820 | 10/1989 | Cozewith et al. | 525/240 |
| 4,990,204 | 2/1991 | Krupp et al. | 156/167 |

FOREIGN PATENT DOCUMENTS

| | | |
|---|---|---|
| 552013 | 7/1993 | European Pat. Off. . |

*Primary Examiner*—Leo B. Tentoni

*Attorney, Agent, or Firm*—Bell, Seltzer, Park & Gibson, P.A.

[57] ABSTRACT

Improved meltspinning productivity is achieved by employing polyolefin resins having key molecular weight distribution and rheological property parameters within predetermined ranges. These parameters include the molecular weight distribution breadth parameter, $M_z/M_n$; and rheological property parameters of flow rate ratio, $I_{10}/I_2$, and the power law index, n, of the regression analysis viscosity equation. These parameters additionally include one or both of the z-average molecular weight, $M_z$, of the resin, or the second order constant, $b_2$, of the regression analysis viscosity equation, and unless both of the latter two parameters are met, the parameters further include the die swell and the spinnability factor (determined from the relationship between die swell and MFR) of the resin.

35 Claims, No Drawings

DISTRIBUTION ENHANCED POLYOLEFIN MELTSPINNING PROCESS AND PRODUCT

FIELD OF THE INVENTION

The invention is directed to meltspinning of polyolefin polymers of enhanced molecular weight distribution. More particularly, the invention is directed to a meltspinning process and product wherein enhanced molecular weight distribution polyolefin polymer is employed to improve the meltspinning process and/or fibers and fabrics resulting therefrom.

BACKGROUND OF THE INVENTION

The production of fibers by meltspinning is widely practiced throughout industry. In general, molten polymer is extruded through a plurality of fine orifices to provide a plurality of fine polymer streams which are then quenched and attenuated. Attenuation or drawing can be accomplished in various ways including mechanically and pneumatically. Mechanical drawing involves the use of precisely controlled filament winding apparatus wherein the speed of the winding apparatus determines the drawing force applied to the quenched fibers. In the pneumatic process, the fibers are passed through a zone of rapidly moving gases, typically air, which apply attenuation force to the filaments.

Polyolefin polymers, particularly polypropylene (both isotactic and syndiotactic) and its copolymers and terpolymers, have been used extensively for meltspinning of fibers. Polyolefins are relatively inexpensive and can provide fibers in a wide range of deniers, strength and hand characteristics.

Polyolefins are available commercially in a wide range of forms. In general, the polymer properties are determined by the average molecular weight of the polyolefin and by the distribution of the various molecular weight fractions within the resin. High molecular weight polyolefin resins in general have a low melt flow rate (MFR) which is a measure of the amount of polymer which can be forced through a given sized orifice at a given temperature. Conversely, low molecular weight polyolefin resins generally have a high MFR. Because of the need for rapid attenuation during the spinning and drawdown process, relatively low molecular weight polyolefin resins are typically employed in meltspinning and typically have an MFR of from 20–50 as measured by ASTM D-1238-82, condition 230/2.16.

Polypropylene is commercially available in two principal grades. The first grade is generally known as CR (Controlled Rheology) grade. Polypropylene of this grade generally has a narrow molecular weight distribution as a result of a visbreaking treatment of the polymer recovered from the polymerization zone. The second and lower grade of polypropylene is generally known as Reactor Grade. This polypropylene generally has a broad molecular weight distribution and has not been subjected to visbreaking. As a result, this material typically undergoes thermal degradation during melt-pelleting or melt-spinning.

Because of physical requirements imposed by the meltspinning process, manufacturers are generally limited in their choices of polyolefin polymer for meltspinning of high quality and relatively fine denier filaments. As indicated above, such polyolefin resins are generally CR grade resins having an MFR of between about 20 and about 50.

In practice there are substantial limitations on increasing spinning productivity. Specifically, increasing the polymer throughput while also increasing the drawdown force applied to the meltspun filaments generally increases process productivity. However, for any particular polymer there is generally a limit to the drawdown force which can be applied to the polymer without also producing an excess number of filament breakages. Although the ability of the polymer to withstand higher drawdown forces can be improved by moving to a higher molecular weight (MW) polymer or by using a broader molecular weight distribution (MWD) polymer, the higher MW or broader MWD polymers typically resist attenuation or drawdown due to high melt elasticity and can also exhibit a greater resistance to flow through the spinneret orifices. In pneumatic, hydraulic, centrifugal and gravitational drawing systems, high melt elasticity will also result in higher filament deniers, at equivalent drawing forces and could also result in increasing the incidence of cohesive failure at elevated drawing force conditions. In either case, the spinning process is harmed and thus "spinnability" is compromised. Conversely, lowering the molecular weight of the polymer generally improves the flow of the polymer through the spinneret orifices but results in a limp spin-line which harms filament laydown and increases the incidence of filament collisions which in turn causes breaks and "marrier filaments", i.e., filaments which bond together on contact. Although the molecular weight distribution can also be narrowed, this results in filaments and fabrics with inferior properties. Specifically thermally bonded spunbond fabrics made with very low MWD polymers tend to exhibit low tensile properties. Thus, the polyolefin fiber producer is faced with practical limitations on improving productivity of the spinning process.

SUMMARY OF THE INVENTION

This invention provides meltspinning processes and products using enhanced molecular weight distribution polyolefin resins. In one advantageous embodiment of the invention, meltspinning of enhanced molecular weight distribution polyolefin resins provides meltspinning of polyolefin fibers under conditions of enhanced productivity such that meltspinning can be conducted using higher polymer throughput rates while providing filaments having deniers the same as filament deniers normally provided with lower polymer throughput speeds. Alternatively, filaments are meltspun according to the invention using polymer throughput speeds which are equivalent to those used with conventional polyolefin fiber resins while, however, providing fibers of lower denier, and thus a higher filament spinning speed.

In accordance with the invention, it has been found that improved meltspinning productivity is achieved by employing polyolefin resins having key molecular weight distribution and rheological property parameters within predetermined ranges. These parameters include the molecular weight distribution breadth parameter, $M_z/M_n$; and rheological property parameters of flow rate ratio, $I_{10}/I_2$, and the power law index, n, of the regression analysis viscosity equation. These parameters additionally include one or both of the z-average molecular weight, $M_z$, of the resin, or the second order constant, $b_2$, of the regression analysis viscosity equation, and unless both of the latter two parameters are met, the parameters further include the die swell and the spinnability factor (determined from the relationship between die swell and MFR) of the resin. It is also preferred that the resin have a calculated viscosity at a shear rate of 20 $s^{-1}$ within a predetermined range.

In general, the polyolefin resins having these key property parameters can be provided by preparing a blended resin including a relatively small portion, e.g. 2–40 wt. percent, based on blend weight, of a low molecular weight, high MFR, narrow molecular weight distribution polyolefin resin, with a larger portion, e.g. 60–98 wt. percent, of a miscible high molecular weight, low MFR and typically narrow molecular weight distribution polyolefin resin. Alternatively, polyolefin resins having the characteristics required according to the invention can be prepared directly during the polymerization process by modifying the polymerization process to provide a greater percentage of low molecular weight polymer in the polymerization polyolefin product.

In general, the polyolefin resins of enhanced molecular weight distribution employed in this invention have been modified to change their rheological response spectrum to provide both good spinnability, and the production of fine denier filaments at higher throughput rates. The change in rheology is brought about by changing the molecular weight distribution. By increasing the amount of low molecular weight polymer included in a relatively high molecular weight polyolefin resin, the fraction of the polymer in the low, but not very low, molecular weight region of the distribution is increased. In a molecular weight distribution curve (fraction versus molecular weight), a portion of the peak above the baseline appears to be broadened.

Meltspinning processes conducted in accordance with the invention can employ either mechanical drawing i.e., using winders to effect filament attenuation, or can employ pneumatic drawing of the filaments i.e., using either air guns or slot draw spunbonding systems. Alternatively, melt spinning processes conducted in accordance with the invention can employ either centrifugal or hydraulic drawing of the filaments. The invention provides for improved productivity throughout a variety of meltspinning filament speeds. In preferred embodiments of the invention, the filament speed during meltspinning is advantageously greater than about 2000 meters/min.

Polyolefin filaments and fabrics prepared according to the invention exhibit desirably high tenacity and tear property values, even though the filaments and fabrics have been prepared under conditions of improved productivity.

DETAILED DESCRIPTION OF THE INVENTION

In the following detailed description of the invention, preferred embodiments of the invention are described to enable practice of the invention. It will be apparent that although specific terms are employed in describing the preferred embodiments of the invention, these terms are used for purposes of description and not for purposes of limiting the invention to its preferred embodiments. In addition, it will be apparent that the invention is suspectable to numerous embellishments, variations and modifications as will become apparent from a consideration of the invention as discussed previously and described in detail below.

Polyolefin resins of enhanced molecular weight distribution can be prepared from any of the various fiber-forming polyolefins as will be known to the skilled artisan including isotactic and sydiotactic polypropylenes and copolymers and terpolymers thereof; polyethylenes including high density polyethylene, linear low density polyethylene and copolymers and terpolymers thereof; poly(1-butene), poly(2-butene), poly(1-pentene), poly(2-pentene), poly(3-methyl-1-pentene), poly(4-methyl-1-pentene), and the like. The preferred polyolefins for use in the invention are polypropylenes and its co- and terpolymers and polycthylene and its co- and terpolymers.

As used herein and only for the purposes of this patent application, the following terms are used to mean the following, and are determined as set forth below.

"Die Swell" also called "Barus Effect" and represented by the symbol "$B^2$" is the square of the ratio of extrudate diameter to die diameter when polymer is extruded according to certain predetermined conditions. Specifically, the polymer is extruded according to ASTM D1238-82, condition 190/2.16 except that the internal configuration of the die through which the polymer is extruded is in the shape of a cone having an angle of 90°, has an exit orifice diameter of 2.0955 mm (±0.0051 mm), and an entrance orifice diameter equal to the diameter described in ASTM D1238-82. The total load, including the piston, is 775 grams. A tall beaker is placed under the die so that the top of the beaker is against the melt index cylinder. The beaker contains silicone fluid, such as Dow Corning 200 fluid at ambient temperature. The liquid level is 5 cm from the top of the beaker. A cut is made through the extrudate when the second scribe mark of the piston enters the cylinder. Just before the leading end of the resultant strand of the extrudate touches the bottom of the beaker, the beaker is lowered and removed. A second cut is made 15 seconds after the first cut, without intervening extrudate being allowed to accumulate. The strand is removed from the beaker and is then wiped with a soft towel. Its diameter 6 mm from the leading end is measured at 5 points around the circumference at equal intervals of 72°. The five measurements are averaged and divided by the diameter of the exit orifice and this ratio is then squared to obtain "$B^2$" or "Die Swell".

The term "Spinnability Factor" as used herein is defined as the natural log of Die Swell divided by meltflow rate (MFR), i.e., $\ln(B^2)/MFR$, wherein $B^2$ is determined as per the above and wherein MFR is determined according to ASTM D-1238-82, condition 230/2.16.

"Flow Rate Ratio"-often termed "$I_{10}/I_2$" is the ratio of the MFR with a 10 kg weight to that with the 2.16 kg weight at 230° C. (ASTM D-1238). If the polymer melt were Newtonian, the FRR would be about 10/2.16 or about 4.6. Values higher than this indicate shear thinning, which is the rule rather than the exception in polymer melts.

"Molecular Weight Distribution Breadth" is defined as $M_z/M_n$. As is well known to the skilled artisan, $M_n$ represents the number average molecular weight ($\Sigma NiMi/\Sigma Ni=\Sigma niMi$), and $M_z$ represents the z-average molecular weight ($\Sigma NiMi^3/\Sigma NiMi^2$), where $\Sigma=\Sigma^{\infty}_{i=1}$. For each fraction which has Mw=Mi(Mi=Mn, i=Mw, i=Mz, i), there are Ni molecules, and the number fraction is ni=Ni/ΣNi, and wi=NiMi/ΣNiMi is the weight fraction. The values for each of these are obtained from SEC (size exclusion chromatography), more specifically GPC (gel permeation chromatography). A Walters Instrument with an RI (refractive index) detector and gel columns is used at 135° C. The solvent is 1,2,4-trichlorobenzene. The calibration is carried out with a broad molecular weight distribution polypropylene standard, $M_n$=43,538 and $M_w$=348,300, (commercially available from PolyScience, 7800 Merrimac Avenue, Niles, Ill.; PolyScience Catalog Number 19910).

The calculated polymer viscosity at 20 $s^{-1}$ in poise is determined by multivariant regression analysis of data from duplicate runs on an Instron Capillary Rheometer wherein data is collected from shear rates of about 16 $s^{-1}$ to over 1600$s^{-1}$ at 230° C. Using well known multivariable regression analysis techniques, this data is then fit to the regression analysis viscosity equation: ln(Shear Stress)=$b_o$+$b_1$ln(shear Rate)+$b_2$(ln(Shear Rate))$^2$. As the L/D of the capillary employed in this instrument is over 40, the entrance and exit correction (Bagly corrections) are considered negligible. The velocity distribution corrections (Rabinowich) are not made as they are negligible and do not affect the results.

The "power law index (at 20 $sec^{-1}$)", "n" is calculated from the above regression equation by taking the first derivative with respect to the log of the shear rate at 20 $sec^{-1}$, i.e., according to the formula:

$$n=b_1+2b_2(\ln(20))$$

Like the flow rate ratio, the power law index is a measure of deviation from true Newtonian flow.

The "Second Order Constant", "$b_2$", of the regression analysis viscosity equation, is found in the regression analysis viscosity equation, itself. The constant, $b_2$, is considered representative of the relationship between the change of the power law index, n, with changes in the shear rate.

In accordance with this invention, it has been found that the polyolefin polymers having values within certain predetermined ranges for the key property parameters discussed above, provide for enhanced productivity meltspinning. In accordance with the invention, the polyolefin resin has a molecular weight distribution breadth, $M_z/M_n$, of between 7.2 and 10, a flow rate ratio (FRR) of less than 15.5, preferably less than or equal to 15.30, and a power law index at 20 $sec^{-1}$, n, of between 0.70 and 0.78. In addition, either the z-average molecular weight, $M_z$, of the resin is between 400,000 and 580,000, preferably between 400,000 and 530,000, more preferably between 400,000 and 480,000; or the second order constant, $b_2$, of the regression analysis viscosity equation, is between −0.029 and −0.047. Unless the resin has values of both of these parameters, i.e., $M_z$ and $b_2$, within these ranges, the resin also has a die swell, ($B^2$), of between 1.6 and 2.0, and a spinnability factor, (ln ($B^2$)/MFR) of between about 0.08 and about 0.026, preferably between about 0.012 and about 0.019.

It is also preferred that the resin have a calculated viscosity at 230° C. and a shear rate of 20 $s^{-1}$ of less than about 4350 poise, preferably less than about 4200 poise, and a MFR determined as set forth above, of between 15 and 70. In greatly preferred embodiments of the invention, the resin meets each of the property parameter requirements set forth above.

Polyolefin filaments produced according to the process of the invention advantageously have a denier below about 5 dpf and more preferably have a denier below about 3 dpf, most preferably less than about 2.5. The filaments may be prepared employing a mechanical drawing system wherein the filaments are wound up from the spinning system using controlled-speed filament winders. Additionally, melt spinning processes conducted in accordance with the invention can employ either centrifugal or hydraulic drawing of the filaments, as well. Preferably, the polyolefin filaments are prepared as a spunbonded fabric using a pneumatic drawdown system employing a plurality of air aspirator guns or a single slot draw attenuation zone, which may be a forced air slot draw zone, a vacuum driven slot draw zone, or an eductor type slot draw zone, as are well known in the art. More preferably, the polyolefin filaments are prepared from a resin primarily comprising polypropylene homo-, co-, or terpolymer resin as a spunbonded fabric.

Filaments and fabrics, including spunbonded polyolefin fabrics and spunbonded polypropylene fabrics, of the invention can advantageously be used in numerous forms and applications including agricultural; hygiene and hygiene component; barrier and barrier component, including medical barrier; fabrics and applications.

The benefits and advantages of the invention can be achieved at filaments speeds ranging from very low, for example, about 500 meters per minute up to extremely high filaments speeds, for example, speeds ranging up to 8,000 meters per minute or greater. In greatly preferred embodiment of the invention, the polyolefin filaments are spun using a pneumatic air aspirator guns or a slot draw system, with filament speeds of about 2,000 meters per minute or greater. It is presently preferred that a filament speed be chosen within the range of from about 2,000 to about 3,500 meters per minute.

The number, size and arrangements of orifices within the spinnerets used to spin filaments according to the invention can be widely varied as will be apparent to those skilled in the art. Typically, the orifices will have a diameter ranging form about 0.2 mm to about 0.8 mm and L/D ranging from about 2 to about 6. In preferred embodiments of the invention, the orifices are arranged in a generally rectangular array for deposit unto a moving belt positioned beneath a pneumatic attenuation zone. In such an arrangement, the spinneret typically includes several 1,000 up to 10,000 or more orifices per meter of machine width, preferably from about 5,000 to about 10,000 orifices per meter of machine width.

As indicated previously, the polyolefin resins which are used in meltspinning according to the invention can be prepared by blending, or can be prepared directly in the polymerization step. Blends are, in general, prepared by employing a polyolefin resin preferably having a relatively narrow molecular weight distribution, i.e. a CR resin, and wherein the MFR of the resin is advantageously 35 or less, preferably about 25 or less, more preferably between about 15 and about 25. To this resin is added a lower molecular weight miscible polyolefin resin in an amount of between 2 and about 45 wt. % and having an MFR greater than about 80–100 preferably greater than 250, more preferably about 400 or more. The properties of the thus prepared blend can be evaluated using the above key properties to determine whether the resin is useful for enhanced polyolefin filament spinning.

Alternatively, the enhanced molecular weight distribution polyolefin resins can be prepared directly in the polymerization process. As is well known in the art, metallocene catalysts can be employed during the polyolefin polymerization process to provide polyolefin resins having the desired molecular weight distribution properties. Such metallocene catalysts and the polymerization processes for their use are generally known to those skilled in the art and are described in, for example, U.S. Pat. No. 4,530,914 to Ewen et al., issued Jul. 23, 1985 and which is incorporated herein by reference.

It will be apparent that the polyolefin polymers useful in this invention may include minor amounts of copolymer and/or terpolymer materials, for example, copolymer and/or terpolymer moieties can be present in substantial amount so long as the resin exhibits primarily polyolefin characteristics. Preferred polyolefin resins include polypropylene homopolymers and copolymers and/or terpolymers, in which the co- and/or terpolymer moieties when present, are present in an amount of up to about 5% by wt., based on the weight of the copolymer and/or terpolymer resin.

The following examples are provided in order to enable practice of the invention.

EXAMPLES 1–33

In each of the Examples set forth and discussed below, spunbonded fabric samples were prepared using an air aspirator gun type spunbonding process. All runs were made with a conventional single screw extruder with a 50 cc spin pump feeding a rectangular spinneret with 756 holes, in 7 rectangular patches. Each capillary was 0.6 mm in diameter with an L/D of 2/1. The filaments from each patch of 108 holes, after quenching at a conventional horizontal air flow quench chamber, entered an air aspirator, which provided the drawdown force. After leaving the air aspirator, tubes and separation devices, the filaments are laid down on a porous screen, as in a paper machine and transported to a calendar stack where the web is heat bonded and wound up into a roll. Filament velocities ranged from about 2,000 to about 3,300 m/min, depending upon final denier and polymer throughput. Pressures of air supplied to the aspirator guns ranged from less than about 5 atmospheres (very low pressure), up to about 20 atmospheres (high pressure).

Spinnability as set forth in the table below is an evaluation of how the spinning process ran. A rating of 5 represents the best score, while a rating of 1 represents a poor score wherein spinning could not be conducted due to excessive snap-offs of filament and/or filaments wandering from aspirator gun to aspirator gun.

The denier values reported in the examples represents an average of measurements of the filaments taken both with optical microscopes and with scanning electron microscopes. The values as to the resins employed were determined as discussed above. Where resin blends were used, the resins employed were commercially available resins having the properties noted. The blends were made using a Davis Standard 2.5 inch compounding extruder equipped with a 5 row cavity transfer mixer (CTM), and the blended resins were strand die cut into pellets mixing apparatus and the blended resin extruded into pellets.

In each spinning run, the speed of the moving screen was adjusted to achieve fabric weights of about 1 oz./sq. yd. However, there were minor variations in fabric weight. Accordingly, the fabric values set forth have been corrected to provide data representative of fabrics having a basis weight of 1 oz./sq. yd. These corrections were minor.

Resin properties for each example are shown in Table 1 (parts 1 and 2). Fabric properties are shown in Table 2.

TABLE 1

(Part 1)

| | | | | | | BLEND | | | | |
|---|---|---|---|---|---|---|---|---|---|---|
| Example No. | Blend | Base Resin MFR | MWD | low MW resin % | Low MW Resin MFR | MFR | FRR | Die Swell | In $B^2$/MFR | Mn |
| 1 (Control) | 0.1 | 26.2 | Narrow | 0 | | 26.2 | 14.4 | 1.54 | 0.0165 | 59560 |
| 2 (Control) | 1 | Shear and heat treated | | 0 | | 42.6 | 17.2 | 1.76 | 0.0133 | 51080 |
| 3 (Control) | 1 | " | | 0 | | 42.6 | 17.2 | 1.76 | 0.0133 | 51080 |
| 4 (Control) | 1 | " | | 0 | | 42.6 | 17.2 | 1.76 | 0.0133 | 51080 |
| 5 (Control) | 1 | " | | 0 | | 42.6 | 17.2 | 1.76 | 0.0133 | 51080 |
| 6 (Control) | 1 | " | | 0 | | 42.6 | 17.2 | 1.76 | 0.0133 | 51080 |
| 7 (Control) | 1 | " | | 0 | | 42.6 | 17.2 | 1.76 | 0.0133 | 51080 |
| 8 (Control) | 1 | " | | 0 | | 42.6 | 17.2 | 1.76 | 0.0133 | 51080 |
| 9 (Control) | 0.2 | 26.2 | Narrow | 0 | | 26.2 | 14.0 | 1.72 | 0.0207 | 67470 |
| 10 (Invention) | 7 | 20.4 | Narrow | 10 | 400 | 27.7 | 14.1 | 1.66 | 0.0182 | 60290 |
| 11 (Invention) | 9 | 20.4 | Narrow | 10 | 850 | 28.4 | 14.2 | 1.66 | 0.0178 | 57620 |
| 12 (Invention) | 7 | 20.4 | Narrow | 10 | 400 | 27.7 | 14.1 | 1.66 | 0.0182 | 60290 |
| 13 (Invention) | 7 | 20.4 | Narrow | 10 | 400 | 27.7 | 14.1 | 1.66 | 0.0182 | 60290 |
| 14 (Invention) | 7 | 20.4 | Narrow | 10 | 400 | 27.7 | 14.1 | 1.66 | 0.0182 | 60290 |
| 15 (Invention) | 9 | 20.4 | Narrow | 10 | 850 | 28.4 | 14.2 | 1.66 | 0.0178 | 57620 |
| 16 (Invention) | 8 | 20.4 | Narrow | 30 | 850 | 65.8 | 10.6 | 1.70 | 0.0081 | 46130 |
| 17 (Invention) | 8 | 20.4 | Narrow | 30 | 850 | 65.8 | 10.6 | 1.70 | 0.0081 | 46130 |
| 18 (Invention) | 6 | 20.4 | Narrow | 30 | 400 | 46.1 | 15.1 | 1.90 | 0.0139 | 44670 |
| 19 (Invention) | 6 | 20.4 | Narrow | 30 | 400 | 46.1 | 15.1 | 1.90 | 0.0139 | 44670 |
| 20 (Invention) | 6 | 20.4 | Narrow | 30 | 400 | 46.1 | 15.1 | 1.90 | 0.0139 | 44670 |
| 21 (Invention) | 17 | 13 | Narrow | 10 | 850 | 18.7 | 15.3 | 1.63 | 0.0259 | 60820 |
| 22 (Invention) | 17 | 13 | Narrow | 10 | 850 | 18.7 | 15.3 | 1.63 | 0.0259 | 60820 |
| 23 (Invention) | 17 | 13 | Narrow | 10 | 850 | 18.7 | 15.3 | 1.63 | 0.0259 | 60820 |
| 24 (Invention) | 17 | 13 | Narrow | 10 | 850 | 18.7 | 15.3 | 1.63 | 0.0259 | 60820 |
| 25 (Comparative) | 4 | 25 | Broad | 30 | 850 | 84.4 | 8.6 | 2.33 | 0.0100 | 33890 |
| 26 (Comparative) | 4 | 25 | Broad | 30 | 850 | 84.4 | 8.6 | 2.33 | 0.0100 | 33890 |
| 27 (Comparative) | 14 | 13 | Narrow | 30 | 400 | 30.1 | 16.7 | 1.94 | 0.0220 | 44200 |
| 28 (Comparative) | 14 | 13 | Narrow | 30 | 400 | 30.1 | 16.7 | 1.94 | 0.0220 | 44200 |
| 29 (Comparative) | 12 | 12 | Broad | 30 | 850 | 56.7 | 12.3 | 3.32 | 0.0212 | 33820 |
| 30 (Comparative) | 5 | 25 | Broad | 10 | 850 | 37.6 | 17.2 | 2.47 | 0.0241 | 40100 |
| 31 (Comparative) | 12 | 12 | Broad | 30 | 850 | 56.7 | 12.3 | 3.32 | 0.0212 | 33820 |
| 32 (Comparative) | 11 | 12 | Broad | 10 | 400 | 15.0 | 17.0 | 4.91 | 0.1058 | 39840 |
| 33 (Comparative) | 10 | 12 | Broad | 30 | 400 | 26.4 | 16.6 | 5.74 | 0.0661 | 35920 |

(Part 2)

| | | Pellet SEC data | | Pellet data at 230° | | | | |
|---|---|---|---|---|---|---|---|---|
| Example No. | Blend | Mz | Mz/Mn | b0 | b1 | b2 | Calc. visc at 20 s-1 | n |
| 1 (Control) | 0.1 | 424600 | 7.13 | 8.282742 | 1.099474 | −0.05067 | 3381 | 0.80 |
| 2 (Control) | 1 | 408100 | 7.99 | 9.335917 | 0.736536 | −0.02316 | 4183 | 0.60 |
| 3 (Control) | 1 | 408100 | 7.99 | 9.335917 | 0.736536 | −0.02316 | 4183 | 0.60 |
| 4 (Control) | 1 | 408100 | 7.99 | 9.335917 | 0.736536 | −0.02316 | 4183 | 0.60 |

TABLE 1-continued

| | | | | | | | | |
|---|---|---|---|---|---|---|---|---|
| 5 (Control) | 1 | 408100 | 7.99 | 9.335917 | 0.736536 | −0.02316 | 4183 | 0.60 |
| 6 (Control) | 1 | 408100 | 7.99 | 9.335917 | 0.736536 | −0.02316 | 4183 | 0.60 |
| 7 (Control) | 1 | 408100 | 7.99 | 9.335917 | 0.736536 | −0.02316 | 4183 | 0.60 |
| 8 (Control) | 1 | 408100 | 7.99 | 9.335917 | 0.736536 | −0.02316 | 4183 | 0.60 |
| 9 (Control) | 0.2 | 635500 | 9.42 | 8.492335 | 1.060542 | −0.04835 | 3789 | 0.77 |
| 10 (Invention) | 7 | 450700 | 7.48 | 8.395971 | 1.040611 | −0.04555 | 3324 | 0.77 |
| 11 (Invention) | 9 | 430400 | 7.47 | 8.326074 | 1.025475 | −0.04301 | 3030 | 0.77 |
| 12 (Invention) | 7 | 450700 | 7.48 | 8.395971 | 1.040611 | −0.04555 | 3324 | 0.77 |
| 13 (Invention) | 7 | 450700 | 7.48 | 8.395971 | 1.040611 | −0.04555 | 3324 | 0.77 |
| 14 (Invention) | 7 | 450700 | 7.48 | 8.395971 | 1.040611 | −0.04555 | 3324 | 0.77 |
| 15 (Invention) | 9 | 430400 | 7.48 | 8.326074 | 1.025475 | −0.04301 | 3030 | 0.77 |
| 16 (Invention) | 8 | 400900 | 8.69 | 8.228788 | 0.896555 | −0.03009 | 2098 | 0.72 |
| 17 (Invention) | 8 | 400900 | 8.69 | 8.228788 | 0.896555 | −0.03009 | 2098 | 0.72 |
| 18 (Invention) | 6 | 440700 | 9.87 | 8.231137 | 0.975821 | −0.03797 | 2485 | 0.75 |
| 19 (Invention) | 6 | 440700 | 9.87 | 8.231137 | 0.975821 | −0.03797 | 2485 | 0.75 |
| 20 (Invention) | 6 | 440700 | 9.87 | 8.231137 | 0.975821 | −0.03797 | 2485 | 0.75 |
| 21 (Invention) | 17 | 488400 | 8.03 | 8.772411 | 0.98678 | −0.04363 | 4193 | 0.73 |
| 22 (Invention) | 17 | 488400 | 8.03 | 8.772411 | 0.98678 | −0.04363 | 4193 | 0.73 |
| 23 (Invention) | 17 | 488400 | 8.03 | 8.772411 | 0.98678 | −0.04363 | 4193 | 0.73 |
| 24 (Invention) | 17 | 488400 | 8.03 | 8.772411 | 0.98678 | −0.04363 | 4193 | 0.73 |
| 25 (Comparative) | 4 | 517500 | 15.27 | 9.701049 | 0.465477 | −0.0019 | 3238 | 0.45 |
| 26 (Comparative) | 4 | 517500 | 15.27 | 9.701049 | 0.465477 | −0.0019 | 3238 | 0.45 |
| 27 (Comparative) | 14 | 471800 | 10.87 | 9.325506 | 0.792848 | −0.03006 | 4605 | 0.61 |
| 28 (Comparative) | 14 | 471800 | 10.87 | 9.325506 | 0.792848 | −0.03006 | 4605 | 0.61 |
| 29 (Comparative) | 12 | 567000 | 16.77 | 8.967569 | 0.697518 | −0.01838 | 2688 | 0.59 |
| 30 (Comparative) | 5 | 599000 | 9.87 | 8.623038 | 0.88597 | −0.03323 | 2931 | 0.75 |
| 31 (Comparative) | 12 | 567000 | 16.77 | 8.967569 | 0.697518 | −0.01838 | 2688 | 0.59 |
| 32 (Comparative) | 11 | 751600 | 18.87 | 9.460851 | 0.723629 | −0.02088 | 4654 | 0.60 |
| 33 (Comparative) | 10 | 830800 | 28.13 | 9.148943 | 0.758751 | −0.02322 | 3706 | 0.62 |

TABLE 2

| | | | | | | FABRIC PROPERTIES | | | | | | | |
|---|---|---|---|---|---|---|---|---|---|---|---|---|---|
| | | | | | | | | | | Trap Tear, lb | | Elmendorf tear, g | |
| Example No. | Blend | Resin Thruput (g/min/hole) | Gun Press. | Spinnability | avg denier | tens, md | ten, cd | tea, md | tea, cd | cd | md | md | cd |
| 1 (Control) | 0.1 | 0.77 | Low | 5.0 | 3.0 | | | | | | | | |
| 2 (Control) | 1 | 0.77 | Low | 4.9 | 3.7 | 1433 | 800 | 278 | 150 | 3.7 | 3.8 | 583 | 585 |
| 3 (Control) | 1 | 0.77 | Mod. | 4.9 | 2.8 | 1315 | 1170 | 238 | 205 | 3.8 | 4.2 | 497 | 510 |
| 4 (Control) | 1 | 0.77 | Mod. | 4.7 | 2.8 | 1876 | 1533 | 318 | 398 | 4 | 4.5 | 1105 | 1186 |
| 5 (Control) | 1 | 0.77 | High | 4.6 | 2.3 | 2464 | 1310 | 361 | 254 | 3.2 | 3.7 | 661 | 583 |
| 6 (Control) | 1 | 1.06 | Low | 2.8 | 3.9 | | | | | | | | |
| 7 (Control) | 1 | 1.06 | Mod. | 3.4 | 3.6 | | | | | | | | |
| 8 (Control) | 1 | 1.06 | Mod. | 2.8 | 3.9 | 1105 | 1006 | 292 | 240 | 3.4 | 4.7 | 788 | 850 |
| 9 (Control) | 0.2 | 1.06 | Mod/High | 4.9 | 3.3 | | | | | | | | |
| 10 (Invention) | 7 | 0.77 | Mod. | 4.0 | 2.5 | 1692 | 1776 | 247 | 532 | 4.2 | 8 | 834 | 825 |
| 11 (Invention) | 9 | 0.77 | Mod. | 4.0 | 2.6 | 2050 | 1399 | 485 | 418 | 4.5 | 5.9 | 809 | 920 |
| 12 (Invention) | 7 | 0.77 | High | 3.4 | 2.1 | 2868 | 1768 | 649 | 418 | 4.2 | 6.3 | 771 | 906 |
| 13 (Invention) | 7 | 1.06 | Low | 4.9 | 3.6 | | | | | | | | |
| 14 (Invention) | 7 | 1.06 | High | 3.4 | 2.9 | 2507 | 1137 | 561 | 356 | 3.8 | 7.1 | 755 | 846 |
| 15 (Invention) | 9 | 1.06 | High | 3.4 | 3.0 | 2060 | 1158 | 388 | 265 | 4.4 | 5 | 688 | 840 |
| 16 (Invention) | 8 | 1.06 | Low | 3.4 | 3.8 | 664 | 299 | 86 | 35 | 3 | 4.1 | 770 | 976 |
| 17 (Invention) | 8 | 1.06 | High | 2.8 | 3.2 | 2163 | 1040 | 416 | 222 | 2.9 | 4.1 | 868 | 986 |
| 18 (Invention) | 6 | 0.77 | Mod. | 4.6 | 2.8 | 2111 | 1490 | 446 | 361 | 3.8 | 5.5 | 666 | 734 |
| 19 (Invention) | 6 | 0.77 | High | 3.4 | 2.2 | 2804 | 1545 | 571 | 308 | 3.9 | 3.9 | 505 | 814 |
| 20 (Invention) | 6 | 1.06 | High | 4.0 | 3.2 | 2108 | 1288 | 329 | 354 | 3.7 | 5.7 | 799 | 780 |
| 21 (Invention) | 17 | 0.77 | Low | 4.9 | 2.9 | 2066 | 935 | 536 | 162 | 5.8 | 5.3 | 844 | 889 |
| 22 (Invention) | 17 | 0.77 | High | 3.4 | 2.4 | 3027 | 1961 | 808 | 596 | 4.9 | 6.7 | 819 | 851 |
| 23 (Invention) | 17 | 1.06 | Mod. | 4.0 | 3.6 | 2125 | 1428 | 570 | 345 | 4.6 | 5.8 | 946 | 901 |
| 24 (Invention) | 17 | 1.06 | High | 4.0 | 3.3 | 2015 | 1713 | 491 | 519 | 4.6 | 6.6 | 946 | 1031 |
| 25 (Comparative) | 4 | 0.77 | High | 4.0 | 2.1 | 2853 | 1302 | 631 | 306 | 4 | 7.3 | 446 | 558 |
| 26 (Comparative) | 4 | 1.06 | High | 2.3 | 3.0 | | | | | | | | |
| 27 (Comparative) | 14 | 0.77 | Low | 2.8 | 2.7 | 2099 | 1186 | 530 | 258 | 5 | 7.1 | 846 | 778 |
| 28 (Comparative) | 14 | 1.06 | High | 4.0 | 3.1 | 2334 | 1293 | 609 | 352 | 4.9 | 6 | 701 | 1096 |
| 29 (Comparative) | 12 | 1.06 | Low | 4.6 | 4.8 | 1412 | 996 | 354 | 223 | 4.3 | 5.7 | 638 | 488 |
| 30 (Comparative) | 5 | 1.06 | Mod. | 3.4 | 4.3 | 1584 | 1497 | 330 | 437 | 7.2 | 7.3 | 895 | 865 |
| 31 (Comparative) | 12 | 1.06 | High | 4.0 | 3.4 | 2150 | 1452 | 440 | 322 | 6.3 | 6.4 | 431 | 621 |
| 32 (Comparative) | 11 | 0.77 | v. Low | 1.0 | 11.3 | | | | | | | | |
| 33 (Comparative) | 10 | 0.77 | v. Low | 1.0 | 7.5 | | | | | | | | |

Examples 1–9 in the above Table are control examples. These examples were conducted using two different lots of a commercially available CR fiber grade polypropylene resins having the MFRs shown in Examples 1 and 9, above. Examples 2–8 were conducted using another commercially available CR fiber grade polypropylene resin that had been subjected to the same shear and heat history as the blends employed in Examples 10–24.

Examples 1–9 illustrate the effect of gun pressure and polymer throughput rate on fiber denier. It can been seen that denier decreases within increasing gun pressure and increases with increasing throughput. The commercially available resins used in Examples 1–9 were deficient with respect to the key properties of resins according to the present invention in various respects. The resins used in Examples 2–8 each had FRR values greater than required according to the present invention. Example 9 has a Mz value in excess of the 580,000 specified by the invention and a $b_2$ value outside of the −0.029 to −0.047 range. Furthermore, Examples 1–8 have rheological parameter values of n, $b_2$, outside of the 0.7 to 0.78; −0.029 to −0.047; ranges, respectively, specified herein.

Examples 10, 11 and 12 employed resins according to the invention and were produced at the lower resin throughput values. Comparison to Examples 1–5 show about a 10% decrease in denier (resulting in a higher filament velocity). The spinnability was good, though the spin line was slightly slack. This could be corrected with a minor change in melt temperature or quench conditions. In general, the fabric properties of Examples 10, 11 and 12 were as good or even better than the properties of fabrics of Examples 2–5, particularly in the CD properties.

Examples 13, 14 and 15 are the same two blends as in Examples 10, 11 and 12, but at higher polymer throughputs. Again, compared to Examples 6–9, the deniers are about 10% less. The spinnability was comparable to the controls or even better. Except for the first Elmendorf tear which was comparable, the fabric properties of Examples 13 and 14 were better than Example 8.

Examples 16 and 17, 18–20 and 21–24 represent 3 different polymers whose properties fall within the definition of the invention. Examples 17, 18, 19, 20, 21, 22, 23 and 24 all exhibited superior tensiles, toughness (TEA) and tear values when compared to the controls at comparable throughput and draw force (gun pressure).

Each of these samples exhibited deniers from roughly equal to 20% lower than the comparable control. Although Example 16 fabric properties appear low, they are superior to the comparable control fabric since the control fabric quality was so low, properties could not be measured.

Examples 25 and 26 are a different resin blend outside the range of this invention in die swell, and also the rheological parameter values of n, $b_2$, and FRR were outside of the 0.7 to 0.78; −0.029 to −0.047; and less than 15.30; ranges, respectively, specified herein. Here at the lower polymer throughput, the denier and spinnability were both good. However, as the throughput increased, even though the resulting denier was low, the spinnability was not good for commercial production. The spin line was very slack and there was an excessive amount of filaments jumping from aspirator to another due to ductile type filament breaks. This is primarily because the spinnability factor was too low, the results of a very high MFR.

Examples 27 and 28 were outside the range of this invention in FRR, viscosity, power law ratio, and molecular weight distribution breadth. Spinning results with these resins are just the opposite as compared to Examples 25 and 26. The spinnability and denier at higher throughput was good, but at the lower throughput the spinnability was poor, again due to a slack spin line and filament wandering between aspirators.

Examples 29, 30 and 31 are two blends that spun well but their deniers were high. The spinnability factor was in the proper range, but the die swells were too high, and the power law ratio, and molecular weight distribution breadth were outside of those specified herein.

Examples 32 and 33 could not be spun except at very low aspirator air pressures, which resulted in very high deniers. Even then, the number of breaks due to snapping off just below the spinneret face were so high that the machine could not be completely threaded up. With the exception of Example 33 viscosity, none of the parameters are within acceptable ranges.

COMPARATIVE EXAMPLE

In order to verify that the properties of the resins used in the invention were different than the properties of commercially available resins conventionally used in the meltspinning process, the key property parameters of conventional CR resins, known to perform well in meltspinning, were measured using the same techniques as in the previous examples and the results are set forth in TABLE 3 below.

TABLE 3

| Control CR Resin | MFR | FRR | Die Swell | In $B^2$)/MFR | Mn |
|---|---|---|---|---|---|
| Control 1 | 26.2 | 14.0 | 1.54 | 0.0165 | 59560 |
| Control 1a | 26.2 | 14.4 | 1.62 | 0.0207 | 67470 |
| Control 2 | 35.1 | 13.4 | 1.65 | 0.0143 | 82940 |
| Control 3 | 33.8 | 13.9 | 1.76 | 0.0168 | 60080 |
| Control 4 | 39.0 | 12.5 | 1.67 | 0.0131 | 73840 |
| Control 5 | 33.2 | 15.3 | 1.88 | 0.0190 | 59840 |

| | | | Pellet data at 230° | | | | |
|---|---|---|---|---|---|---|---|
| Control CR Resin | Mz | Mz/Mn | b0 | b1 | b2 | Calc. visc at 20 $s^{-1}$ | n |
| Control 1 | 424600 | 7.13 | 8.282742 | 1.099474 | −0.05067 | 3381 | 0.80 |
| Control 1a | 635500 | 9.42 | 8.492335 | 1.060542 | −0.04835 | 3789 | 0.77 |
| Control 2 | 317300 | 3.83 | 8.420074 | 1.420670 | −0.04177 | 3358 | 0.77 |
| Control 3 | 267500 | 4.45 | 8.242620 | 1.036456 | −0.04105 | 2950 | 0.79 |

TABLE 3-continued

| | | | | | | | |
|---|---|---|---|---|---|---|---|
| Control 4 | 291300 | 3.95 | 8.498596 | 0.978568 | −0.03802 | 3272 | 0.75 |
| Control 5 | 330500 | 5.52 | 8.718879 | 0,916496 | −0.03965 | 3522 | 0.71 |

As can be seen from the data of TABLE 3, Controls 1 and 1a, which are the same resins as Examples 1 and 9, respectively, in Table 1, are deficient in several property parameters. Control 1 has a power law index value which is too high and a $b_2$ which is too small while Control 1a has a Mz value in excess of the 580,000 value specified by the invention and a $b_2$ value outside of the −0.029 to −0.047 range. Controls 2–5 are other widely used CR resins. The conventional resins 2–5 were all deficient with respect to Mz and Mz/Mn, and the power law index value of Control 3 was high.

The invention has been described in considerable detail with reference to its preferred embodiments. It will be apparent however, that variations and modifications can be made without departure from the spirit of the invention as described in the foregoing detailed specification and as defined in the appended claims.

That which is claimed is:

1. An enhanced productivity meltspinning process for meltspinning polyolefin filaments comprising:

extruding molten polyolefin through a plurality of filament forming orifices to form a plurality of filaments, quenching said filaments and subjecting said quenched filaments to an attenuation force, wherein the polyolefin resin supplied to the filament forming orifices is an enhanced molecular weight distribution polyolefin resin having property parameters comprising;

(i) a molecular weight distribution breadth, $M_z/M_n$, of between 7.2 and 10, a flow rate ratio of less than 15.5, and a power law index at 20 $sec^{-1}$ of between 0.70 and 0.78; and (ii) either a z-average molecular weight, $M_z$, of between 400,000 and 580,000, or a second order constant, $b_2$, determined from the regression analysis viscosity equation, of between −0.029 and −0.047, or both; and (iii) unless both of the $M_z$ and $b_2$ parameters is within said ranges of between 400,000 and 580,000, and between −0.029 and −0.047, respectively, a die swell, $B^2$, of between 1.6 and 2.0, and a spinnability factor $\ln(B^2)/MFR$ of between about 0.08 and about 0.026.

2. The meltspinning process of claim 1 wherein said polyolefin resin of enhanced molecular weight distribution comprises a calculated viscosity at 230° C. and a shear rate of 20 $s^{-1}$ of less than about 4350 poise.

3. The meltspinning process of claim 1 wherein said polyolefin resin of enhanced molecular weight distribution comprises a melt flow rate determined according to ASTM D-1238-82, condition 230/2.16, of between 15 and 70.

4. The meltspinning process of claim 1 wherein said polyolefin resin of enhanced molecular weight distribution comprises a flow rate ratio of less than or equal to 15.30.

5. The meltspinning process of claim 1 wherein said polyolefin resin of enhanced molecular weight distribution comprises a z-average molecular weight, $M_z$, of between 400,000 and 480,000.

6. The meltspinning process of claim 1 wherein said polyolefin resin of enhanced molecular weight distribution comprises a spinnability factor $\ln(B^2)/MFR$ of between about 0.012 and about 0.019.

7. The meltspinning process of claim 1 wherein the attenuation force applied to said quenched polyolefin filaments is applied by a filament winding apparatus.

8. The meltspinning process of claim 1 wherein said attenuation force applied to said quenched polyolefin filaments is applied by a pneumatic drawdown system.

9. The meltspinning process of claim 8 wherein the pneumatic drawdown system comprises a plurality of air aspirator guns.

10. The meltspinning process of claim 8 wherein the pneumatic drawdown system is a slot draw attenuation zone.

11. The meltspinning process of claim 8 wherein the quenched filaments achieve a velocity of between about 500 meters/minute up to about 5000 meters/minute during said meltspinning process.

12. The meltspinning process of claim 11 wherein said quenched polyolefin filaments achieve a velocity of greater than about 2000 meters/minute during said meltspinning process.

13. The meltspinning process of claim 11 additionally comprising the steps of depositing said filaments on a moving screen to form a spunbonded fabric.

14. An enhanced productivity meltspinning process for meltspinning polypropylene filaments comprising:

extruding molten polypropylene through a plurality of filament forming orifices to form a plurality of filaments, quenching said filaments and subjecting said quenched filaments to an attenuation force, wherein the polypropylene resin supplied to the filament forming orifices is an enhanced molecular weight distribution polypropylene resin having property parameters comprising;

(i) a molecular weight distribution breadth, $M_z/M_n$, of between 7.2 and 10, a flow rate ratio of less than 15.5, and a power law index at 20 $sec^{-1}$ of between 0.70 and 0.78; and (ii) either a z-average molecular weight, $M_z$, of between 400,000 and 580,000, or a second order constant, $b_2$, determined from the regression analysis viscosity equation, of between −0.029 and −0.047, or both; and (iii) unless both of the $M_z$ and $b_2$ parameters is within said ranges of between 400,000 and 580,000, and between −0.029 and −0.047, respectively, a die swell, $B^2$, of between 1.6 and 2.0, and a spinnability factor $\ln(B^2)/MFR$ of between about 0.08 and about 0.026.

15. The meltspinning process of claim 14 wherein said polypropylene resin of enhanced molecular weight distribution comprises a melt flow rate determined according to ASTM D-1238-82, condition 230/2.16, of between 15 and 70.

16. The meltspinning process of claim 14 wherein said polypropylene resin of enhanced molecular weight distribution comprises a flow rate ratio of less than or equal to 15.30.

17. The meltspinning process of claim 14 wherein said polypropylene resin of enhanced molecular weight distribution comprises a z-average molecular weight, $M_z$, of between 400,000 and 480,000.

18. The meltspinning process of claim 14 wherein said polypropylene resin of enhanced molecular weight distribution comprises a spinnability factor $\ln(B^2)/MFR$ of between about 0.012 and about 0.019.

19. The meltspinning process of claim 14 wherein said polypropylene resin of enhanced molecular weight distribution comprises both a z-average molecular weight, $M_z$, of between 400,000 and 580,000, and a second order constant, $b_2$, determined from the regression analysis viscosity equation, of between −0.029 and −0.047.

20. The meltspinning process of claim 14 wherein said attenuation force applied to said quenched polypropylene filaments is applied by a pneumatic drawdown system.

21. The meltspinning process of claim 20 wherein the pneumatic drawdown system comprises a plurality of air aspirator guns.

22. The meltspinning process of claim 20 wherein the pneumatic drawdown system is a slot draw attenuation zone.

23. The meltspinning process of claim 22 wherein the quenched filaments achieve a velocity of between about 500 meters/minute up to about 5000 meters/minute during said meltspinning process.

24. The meltspinning process of claim 22 additionally comprising the steps of depositing said filaments on a moving screen to form a spunbonded fabric.

25. The meltspinning process of claim 14 wherein said polypropylene resin of enhanced molecular weight distribution primarily comprises a polypropylene copolymer or terpolymer resin.

26. An enhanced productivity meltspinning process for meltspinning polypropylene filaments comprising:

extruding molten polypropylene through a plurality of filament forming orifices to form a plurality of filaments, quenching said filaments and subjecting said quenched filaments to an attenuation force, wherein the polypropylene resin supplied to the filament forming orifices is an enhanced molecular weight distribution polypropylene resin having property parameters comprising;

a molecular weight distribution breadth, $M_z/M_n$, of between 7.2 and 10, a flow rate ratio of less than 15.5, and a power law index at 20 $sec^{-1}$ of between 0.70 and 0.78, a z-average molecular weight, $M_z$, of between 400,000 and 580,000, a second order constant, $b_2$, determined from the regression analysis viscosity equation, of between −0.029 and −0.047, a die swell, $B^2$, of between 1.6 and 2.0, and a spinnability factor $\ln(B^2)/MFR$ of between about 0.08 and about 0.026.

27. The meltspinning process of claim 26 wherein said polypropylene resin of enhanced molecular weight distribution comprises a melt flow rate determined according to ASTM D-1238-82, condition 230/2.16, of between 15 and 70.

28. The meltspinning process of claim 26 wherein said polypropylene resin of enhanced molecular weight distribution comprises a flow rate ratio of less than or equal to 15.30.

29. The meltspinning process of claim 26 wherein said polypropylene resin of enhanced molecular weight distribution comprises a z-average molecular weight, $M_z$, of between 400,000 and 480,000.

30. The meltspinning process of claim 26 wherein said polypropylene resin of enhanced molecular weight distribution comprises a spinnability factor $\ln(B^2)/MFR$ of between about 0.012 and about 0.019.

31. The meltspinning process of claim 26 wherein said attenuation force applied to said quenched polypropylene filaments is applied by a pneumatic drawdown system.

32. The meltspinning process of claim 31 wherein the pneumatic drawdown system comprises a plurality of air aspirator guns.

33. The meltspinning process of claim 32 wherein the pneumatic drawdown system is a slot draw attenuation zone.

34. The meltspinning process of claim 33 wherein the quenched filaments achieve a velocity of between about 500 meters/minute up to about 5000 meters/minute during said meltspinning process.

35. The meltspinning process of claim 34 additionally comprising the steps of depositing said filaments on a moving screen to form a spunbonded fabric.

* * * * *